US010350645B2

(12) United States Patent
Suda et al.

(10) Patent No.: US 10,350,645 B2
(45) Date of Patent: Jul. 16, 2019

(54) ARTICLE REJECTING SYSTEM

(71) Applicant: ISHIDA CO., LTD., Kyoto-shi, Kyoto (JP)

(72) Inventors: Shoji Suda, Ritto (JP); Emi Mizuno, Ritto (JP); Ken Iwakawa, Ritto (JP); Kohei Hayashida, Ritto (JP); Yuzuru Yamada, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 15/903,580

(22) Filed: Feb. 23, 2018

(65) Prior Publication Data

US 2018/0250715 A1 Sep. 6, 2018

(30) Foreign Application Priority Data

Mar. 1, 2017 (JP) ..... 2017-038467

(51) Int. Cl.
*B07C 5/28* (2006.01)
*B07C 5/36* (2006.01)
*B07C 5/342* (2006.01)

(52) U.S. Cl.
CPC ..... *B07C 5/362* (2013.01); *B07C 5/36* (2013.01); *B07C 5/28* (2013.01); *B07C 5/3422* (2013.01)

(58) Field of Classification Search
CPC B07C 5/28; B07C 5/3422; B07C 5/36; B07C 5/362
USPC ..... 209/552
See application file for complete search history.

(56) References Cited

U.S. PATENT DOCUMENTS 3,472,371 A * 10/1969 Ayerst ..... B07B 7/08 209/2
4,165,277 A * 8/1979 Frewin ..... B07C 5/3408 209/3.3
2017/0341110 A1* 11/2017 Ackley ..... G01N 21/8806

FOREIGN PATENT DOCUMENTS

EP 2060884 A1 * 5/2009 ..... B07C 5/18
EP 2060884 A1 5/2009
EP 3121570 A1 * 1/2017 ..... G01G 19/035
JP 5960939 B2 8/2016
WO WO-2015141670 A1 * 9/2015 ..... G01G 19/035
(Continued)

OTHER PUBLICATIONS

An Extended Search Report of the corresponding European Patent Application No. 18159141.3, dated Jun. 28, 2018.

*Primary Examiner* — Terrell H Matthews
(74) *Attorney, Agent, or Firm* — Global IP Counselors, LLP

(57) ABSTRACT

An article rejecting system includes: a conveyance unit that conveys an article along a conveying direction; a detection unit that detects the article which is conveyed by the conveyance unit; a rejecting unit that is provided on a downstream side of the detection unit in the conveying direction and performs a rejecting motion for rejecting the article which is conveyed by the conveyance unit; a control unit that controls the rejecting unit such that the rejecting motion is performed at a predetermined automatic timing when the detection unit detects the article; and an input unit that accepts input of a manual operation for causing the rejecting unit to perform the rejecting motion at a manual timing. The control unit sets the automatic timing based on the manual timing, if the input unit accepts the input of the manual operation when the detection unit detects the article.

8 Claims, 5 Drawing Sheets

(56) References Cited

FOREIGN PATENT DOCUMENTS

WO 2015141670 A1 4/2017

* cited by examiner

ARTICLE REJECTING SYSTEM

BACKGROUND OF THE INVENTION

Field of the Invention

The present disclosure relates to an article rejecting system.

Related Background Art

In the related art, for example, an article rejecting system disclosed in Japanese Patent No. 5960939 is known. The article rejecting system disclosed in Japanese Patent No. 5960939 is provided with a conveyance unit that conveys an article along a conveying direction, a detection unit that detects the article which is conveyed by the conveyance unit, a rejecting unit that performs a rejecting motion for rejecting the article which is conveyed by the conveyance unit, and a control unit that controls the rejecting unit.

SUMMARY

In the article rejecting system as described above, the control unit controls the rejecting unit such that the rejecting motion is performed at a predetermined timing (hereinafter, referred to as an "automatic timing") when the detection unit such as a photoelectric sensor, for example, detects the article. In the related art, an operator estimates a delay time from when the detection unit detects the article to when the rejecting unit performs the rejecting motion, and the operator inputs the delay time as a numerical value, whereby setting of the automatic timing is performed. However, in this case, the operator can determine whether the input delay time is appropriate, only after the article rejecting system is launched, and therefore, it may take time to set an appropriate automatic timing.

An object of an aspect of the present disclosure is to provide an article rejecting system capable of setting an automatic timing expediently.

According to an aspect of the present disclosure, there is provided an article rejecting system including: a conveyance unit that conveys an article along a conveying direction; a detection unit that detects the article which is conveyed by the conveyance unit; a rejecting unit that is provided on a downstream side of the detection unit in the conveying direction and performs a rejecting motion for rejecting the article which is conveyed by the conveyance unit; a control unit that controls the rejecting unit such that the rejecting motion is performed at a predetermined automatic timing when the detection unit detects the article; and an input unit that accepts input of a manual operation for causing the rejecting unit to perform the rejecting motion at a manual timing, in which the control unit sets the automatic timing based on the manual timing, if the input unit accepts the input of the manual operation when the detection unit detects the article.

In the article rejecting system according to an aspect of the present disclosure, an operator performs the manual operation that causes the rejecting unit to perform the rejecting motion at the manual timing, whereby the automatic timing is set based on the manual timing. The operator can perform the input of the manual operation while visually determining the manual timing at which the article is appropriately rejected, while running the article rejecting system. Accordingly, a time required for setting the automatic timing is reduced compared to a case where an operator estimates a delay time and inputs the delay time as a numerical value. Therefore, according to the above article rejecting system, the automatic timing can be set expediently.

In the article rejecting system according to an aspect of the present disclosure, the control unit may store the conveyance speed of the conveyance unit and a time period from when the detection unit detects the article to when the input unit accepts the input of the manual operation. According to the above configuration, performing the manual operation again can be omitted by using the stored conveyance speed and time period, at the time of restart or the like of the article rejecting system, for example.

The article rejecting system according to an aspect of the present disclosure may further include a display unit that displays a time period from when the detection unit detects the article to when the input unit accepts the input of the manual operation, when the input unit accepts the input of the manual operation, and the input unit may accept input of an adjustment operation for adjusting the time period displayed on the display unit, and the control unit may set the automatic timing based on the adjusted time period. According to the above configuration, an operator adjusts the time period displayed on the display unit, whereby the automatic timing can be set expediently.

In the article rejecting system according to an aspect of the present disclosure, the control unit may re-set the automatic timing according to a conveyance speed when the conveyance speed of the conveyance unit is changed. According to the above configuration, even if the conveyance speed of the conveyance unit is changed, the automatic timing according to the changed conveyance speed of the conveyance unit is re-set by the control unit, and therefore, performing the manual operation again can be omitted. Further, for example, even if the conveyance speed when an operator performs the manual operation is a conveyance speed lower than the conveyance speed when the article rejecting system runs normally, since the automatic timing according to the conveyance speed during the normal running is re-set by the control unit, the operator can perform the manual operation at the conveyance speed which allows the operator to determine the manual timing easily and visually.

The article rejecting system according to an aspect of the present disclosure may further include an inspection unit that is provided on an upstream side of the rejecting unit in the conveying direction and inspects the article which is conveyed by the conveyance unit. According to the above configuration, the article can be rejected according to the inspection result of the article.

In the article rejecting system according to an aspect of the present disclosure, the input unit may be provided to at least one of the inspection unit, the rejecting unit, and a portable device distant from the inspection unit and the rejecting unit. According to the above configuration, a place where the input unit is provided is selected according to the distance between the inspection unit and the rejecting unit, whereby an operator can perform the input of the manual operation while visually observing the rejecting motion of the rejecting unit.

In the article rejecting system according to an aspect of the present disclosure, the detection unit may be an inspection unit that inspects the article which is conveyed by the conveyance unit, and the control unit may control the rejecting unit such that the rejecting motion is performed at the automatic timing when the inspection unit inspects the article. According to the above configuration, it is possible to omit a part such as a photoelectric sensor, for example, by using the output of the inspection unit as the detection unit.

In the article rejecting system according to an aspect of the present disclosure, the input unit may accept input of an article setting operation for setting the article subjected to a performance of the rejecting motion by the rejecting unit, and the control unit may store a conveyance speed of the conveyance unit and a time period from when the detection unit detects the article to when the input unit accepts the input of the manual operation, in association with the set article, when the input unit accepts the input of the manual operation and the input of the article setting operation, and set the automatic timing based on the stored time period associated with the article set by the article setting operation, if the time period is stored when the input unit accepts the input of the article setting operation. According to the above configuration, for example, in a case of handling a plurality of types of articles as articles subjected to a performance of the rejecting motion by the rejecting unit, the conveyance speed and the time period for each article can be stored in association with the article in the control unit in advance. In this way, for example, even in a case where an appropriate automatic timing differs for each type of the article, it is possible to set the automatic timing according to the article set by the article setting operation without performing the manual operation again, by using the conveyance speed and time period stored in advance.

According to an aspect of the present disclosure, it is possible to provide an article rejecting system capable of setting an automatic timing expediently.

DESCRIPTION OF EMBODIMENTS

Figure 1:
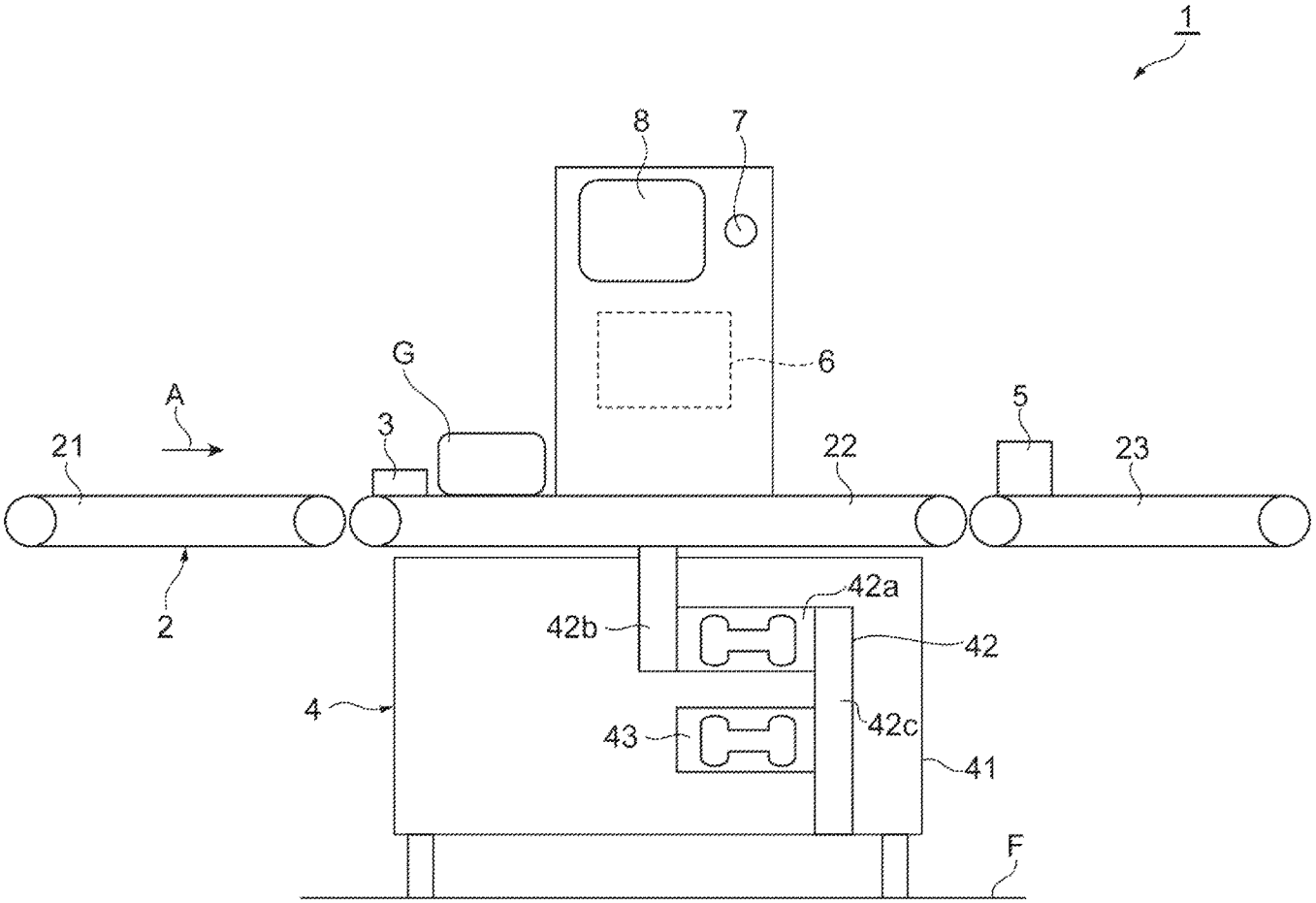
FIG. 1 is a front view of an article rejecting system of an embodiment of the present disclosure.

Hereinafter, an embodiment of the present disclosure will be described in detail with reference to the drawings. In each drawing, identical or corresponding parts are denoted by the same reference numerals, and overlapping description is omitted.

Configuration of Article Rejecting System

As shown in FIG. 1, an article rejecting system 1 is provided with a conveyance unit 2, a detection unit 3, an inspection unit 4, a rejecting unit 5, a control unit 6, an input unit 7, and a display unit 8. The article rejecting system 1 is installed in a production line for an article G such as food, for example. The article rejecting system 1 weighs the weight of the article G while conveying the article G along a conveying direction A and rejects the article G according to the weighing result of the article G.

The conveyance unit 2 conveys the article G along the conveying direction A. The conveyance unit 2 has transport conveyors 21, 22, and 23 provided in alignment along the conveying direction A. The detection unit 3 is, for example, a photoelectric sensor and is provided at an upstream end of the central transport conveyor 22. The detection unit 3 detects the article G which is conveyed by the conveyance unit 2.

The inspection unit 4 is provided at the central transport conveyor 22. The inspection unit 4 weighs the weight of the article G which is conveyed by the transport conveyor 22 (that is, performs weight inspection). The inspection unit 4 can perform "moving weighing" which weighs the weight of the article G without stopping the conveyance of the article G, and "stationary weighing" which stops the conveyance of the article G and weighs the weight of the article G. As an example, the inspection unit 4 has a frame 41, a weighing cell 42, and an AFV (Anti-Floor Vibration) cell 43.

The weighing cell 42 weighs the weight of the article G which is located on the transport conveyor 22. The weighing cell 42 is configured of a strain body 42*a*, a movable rigid body part 42*b*, and a fixed rigid body part 42*c*. The strain body 42*a* is connected to each of the movable rigid body part 42*b* and the fixed rigid body part 42*c*. The movable rigid body part 42*b* supports the transport conveyor 22. The fixed rigid body part 42*c* is fixed to the frame 41. The weighing cell 42 outputs a weighing signal corresponding to the weight of the article G to a first filter unit (not shown) and the control unit 6. The first filter unit performs filtering processing on the weighing signal output from the weighing cell 42, thereby removing noise from the weighing signal, and outputs the weighing signal subjected to the filtering processing to the control unit 6.

The AFV cell 43 detects disturbance vibration of the inspection unit 4 which includes the weighing cell 42 (vibration which is transmitted from a floor F to the inspection unit 4, vibration of the transport conveyor 22, or the like). The AFV cell 43 is connected to the fixed rigid body part 42*c*. The AFV cell 43 outputs a vibration signal corresponding to the disturbance vibration to a second filter unit (not shown). The second filter unit performs filtering processing on the vibration signal output from the AFV cell 43, thereby removing noise from the vibration signal, and outputs the vibration signal subjected to the filtering processing to the control unit 6. In the control unit 6, the influence of the disturbance vibration or the like is canceled from the weighing signal, based on the weighing signal output from the weighing cell 42, the weighing signal output from the first filter unit, and the vibration signal output from the second filter unit.

Figure 2:
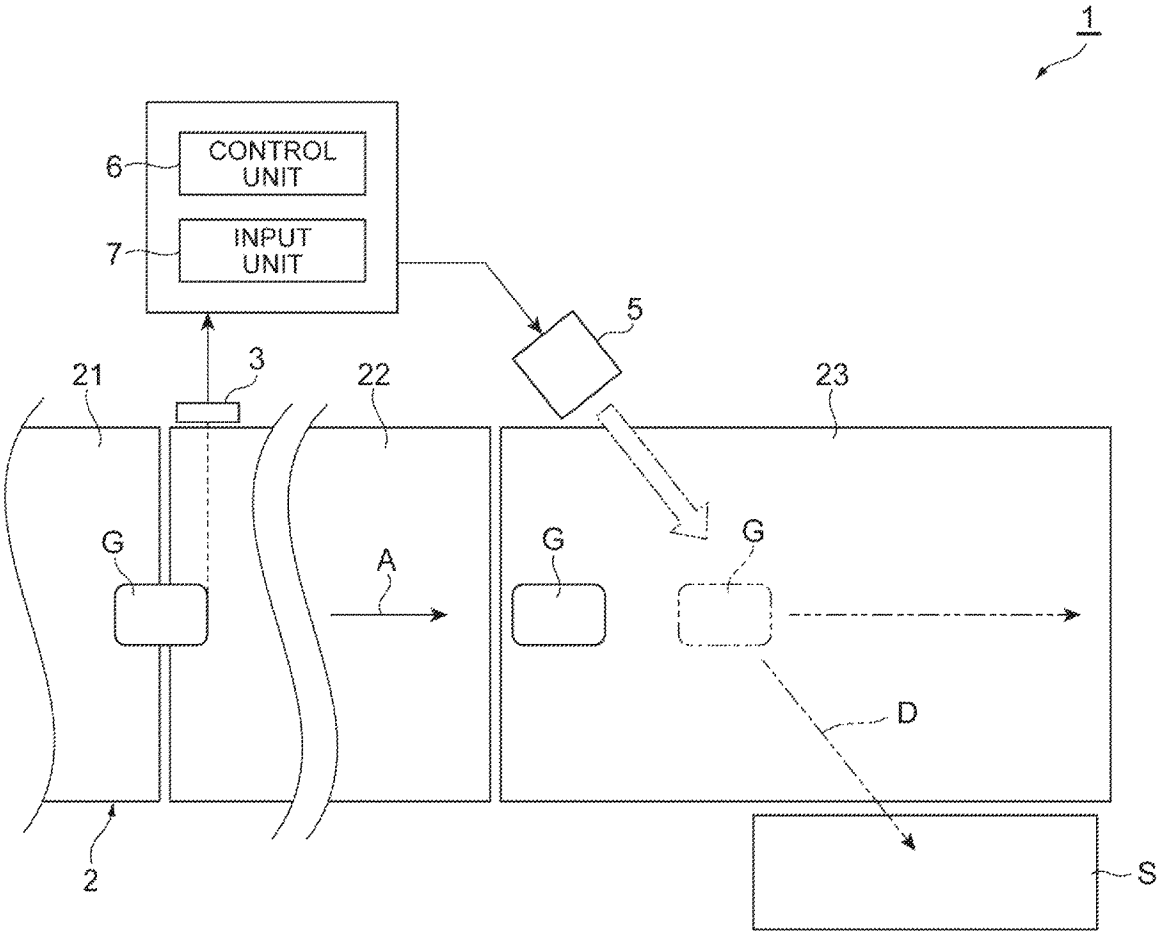
FIG. 2 is a plan view for describing a rejecting motion in the article rejecting system shown in FIG. 1.

As shown in FIGS. 1 and 2, the rejecting unit 5 performs a rejecting motion for rejecting the article G. The rejecting unit 5 is, for example, an air jet type rejecting device. The rejecting unit 5 is provided at the transport conveyor 23 on the side furthest downstream in the conveying direction A. For example, the rejecting unit 5 is disposed such that an operator can easily visually observe the rejecting motion of the rejecting unit 5 from the position of the inspection unit 4. The rejecting unit 5 rejects the article G which is conveyed by the transport conveyor 23, in response to the weighing result of the article G by the inspection unit 4. As an example of the rejecting motion, in a case where the weight of the article G weighed by the inspection unit 4 is out of a predetermined range, the rejecting unit 5 ejects air to a predetermined position of the article G in the conveying direction A. In this way, the article G is rejected in a rejecting direction D, thereby being discharged from the transport conveyor 23, and collected in a chute S. On the other hand, in a case where the weight of the article G weighed by the inspection unit 4 is within the predetermined range, the rejecting unit 5 does not eject air. In this way, the article G is conveyed by the transport conveyor 23.

The control unit 6 controls a motion of each unit in the article rejecting system 1. The control unit 6 controls the rejecting motion of the rejecting unit 5 based on the inspection result of the inspection unit 4, while controlling a timing of the weight inspection of the inspection unit 4 and a timing of the rejecting motion of the rejecting unit 5 with the detection of the article G by the detection unit 3 as a trigger. The control unit 6 is configured as a computer device which includes a processor, a memory, a storage, a communication device, and the like. In the control unit 6, the processor executes predetermined software (program) read into the memory or the like and controls reading and writing of data in the memory and the storage, and communication by the communication device, whereby the function of the control unit 6 is realized. That is, the control unit 6 is a circuit configured to execute control of a timing of the weight inspection of the inspection unit 4 and a timing of the rejecting motion of the rejecting unit 5 with the detection of the article G by the detection unit 3 as a trigger, and control of the rejecting motion of the rejecting unit 5 based on a detection timing of the article G by the detection unit 3 and the inspection result of the inspection unit 4. The detection timing is a timing at which the detection unit 3 detects the article G.

The input unit 7 accepts various types of input from an operator, such as input of running conditions from the operator. The display unit 8 displays a variety of information such as the weight of the article G weighed by the inspection unit 4. The display unit 8 may have a function as an input unit by being configured as a touch panel, for example.

Setting of Automatic Timing

The control unit 6 controls the rejecting unit 5 such that the rejecting motion is performed at a predetermined automatic timing, when the detection unit 3 detects the article G. That is, the control unit 6 is a circuit configured to execute the control of the rejecting unit 5 such that the rejecting motion is performed at a predetermined automatic timing, when the detection unit 3 detects the article G. The automatic timing is a timing at which the control unit 6 causes the rejecting unit 5 to perform the rejecting motion with the detection of the article G by the detection unit 3 as a trigger. The automatic timing is, for example, a timing when a delay time corresponding to a conveyance speed of the conveyance unit 2 has elapsed since the detection unit 3 detects the article G.

The article rejecting system 1 has a setting mode for setting the automatic timing. In the article rejecting system 1, an operator performs input of a manual operation in the setting mode, whereby setting of the automatic timing can be made. The input of the manual operation is hand-operated input by an operator for causing the control unit 6 to set the automatic timing. The input of the manual operation is accepted by the input unit 7.

Figure 3:
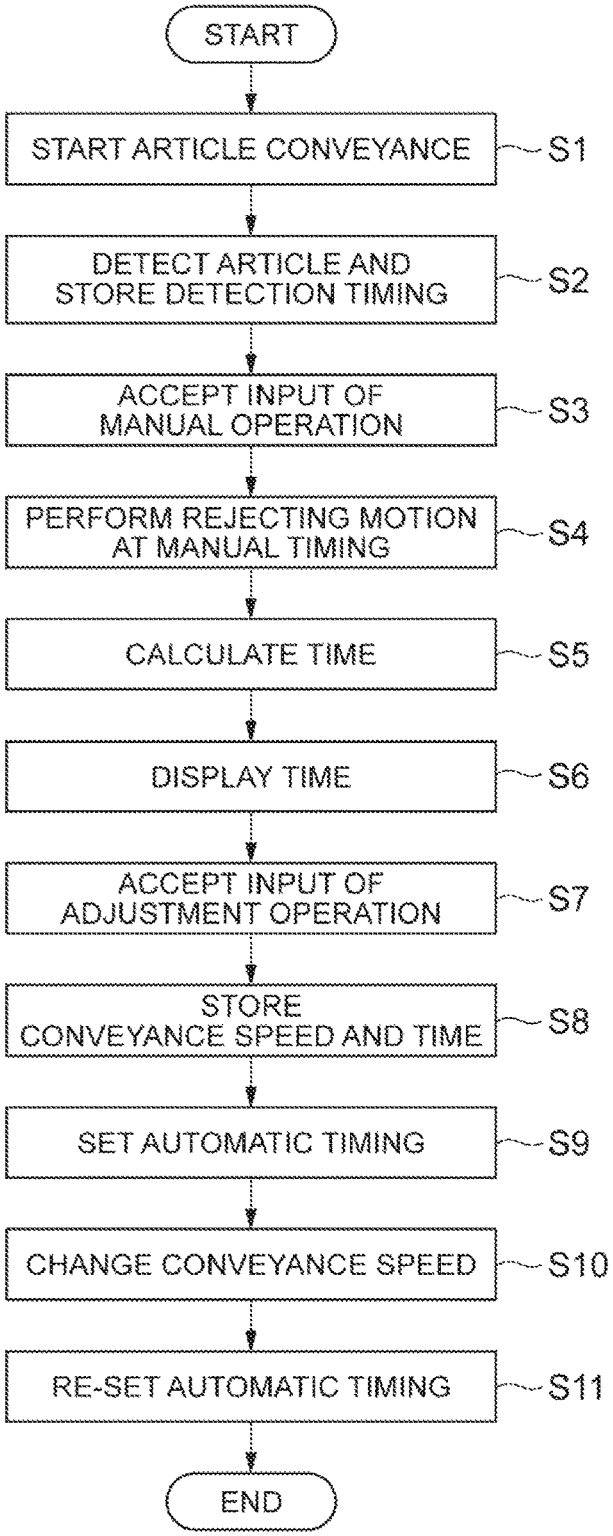
FIG. 3 is an example of a flowchart showing the procedure of setting an automatic timing in the article rejecting system shown in FIG. 1.

Hereinafter, the setting procedure of the automatic timing using the input of the manual operation will be described with reference to FIGS. 2 and 3. Here, as an example, a case will be described where a first conveyance speed of the conveyance unit 2 in the setting mode is lower than a second conveyance speed of the conveyance unit 2 when the article rejecting system 1 runs normally. The first conveyance speed is, for example, a conveyance speed at which an operator can easily visually determine a timing (a manual timing) at which the rejecting unit 5 can appropriately reject the article G. The first conveyance speed and the second conveyance speed may be, for example, substantially constant speeds set in advance or may be speeds set by an operator.

First, an operator performs input for running the article rejecting system 1 in the setting mode. In this way, the control unit 6 causes the conveyance unit 2 to start the conveyance of the article G (step S1). The conveyance speed at this time is the first conveyance speed. If the article G is conveyed by the conveyance unit 2, the detection unit 3 detects the article G and the control unit 6 stores a detection timing of the article G by the detection unit 3 (step S2).

If the article G is further conveyed by the conveyance unit 2, the article G reaches a predetermined position where the rejecting unit 5 ejects air. Here, an operator performs the input of the manual operation while the operator visually determines the manual timing at which the rejecting unit 5 can appropriately reject the article G. That is, the manual timing is a timing at which the operator should perform the input of the manual operation in order to cause the rejecting unit 5 to appropriately reject the article G. If the operator performs the input of the manual operation, the input unit 7 accepts the input of the manual operation (step S3) and at the same time (that is, at the manual timing), the control unit 6 causes the rejecting unit 5 to perform the rejecting motion (step S4). At this time, the control unit 6 acquires a rejecting timing of the article G by the rejecting unit 5 and calculates a time period from when the detection unit 3 detects the article G to when the input unit 7 accepts the input of the manual operation, based on the rejecting timing and the detection timing stored in step S2 (step S5). Then, the control unit 6 causes the display unit 8 to display the time period (step S6).

In a case where the article G is appropriately rejected by the rejecting motion, the operator recognizes that adjustment for appropriately rejecting the article G is not required. On the other hand, in a case where there is room for the article G to be rejected more appropriately, the operator recognizes that adjustment for appropriately rejecting the article G is required. The adjustment is adjustment of the automatic timing set based on the manual timing described above.

In a case where the operator recognizes that the adjustment is required, the operator performs input of an adjustment operation while considering whether the result of the rejecting motion performed at the manual timing is good or bad. If the operator performs the input of the adjustment operation, the input unit 7 accepts the input of the adjustment operation (step S7). The adjustment operation is an operation by an operator for adjusting the automatic timing such that the rejecting unit 5 rejects the article G at a more appropriate timing. The adjustment operation may be an operation in which the operator adjusts the time period displayed on the display unit 8. If the adjustment operation is completed, the operator performs input of a timing setting operation. The timing setting operation is an operation by an operator for confirming the setting of the automatic timing in response to the input of the manual operation. If the input unit 7 accepts the input of the timing setting operation, the control unit 6 stores the adjusted time period and the conveyance speed of the conveyance unit 2 in association with each other (step S8). Subsequently, the control unit 6 applies the adjusted time period as the delay time, whereby the control unit 6 sets the automatic timing (step S9).

In a case where the operator recognizes that the adjustment is not required, the operator does not perform the input of the adjustment operation but performs the input of the timing setting operation. In this case, in step S8, the control unit 6 stores the time period calculated in step S5 and the conveyance speed of the conveyance unit 2 in association with each other. Subsequently, in step S9, the control unit 6 applies the time period calculated in step S5 as the delay time, whereby the control unit 6 sets the automatic timing.

Subsequently, the operator performs input for causing the article rejecting system 1 to run normally, and the control unit 6 changes the conveyance speed of the conveyance unit 2 from the first conveyance speed to the second conveyance speed (step S10). In this way, the control unit 6 revises the time period stored in step S8, based on a ratio between the conveyance speed (the first conveyance speed) stored in step S8 and the conveyance speed (the second conveyance speed) changed in step S10. Then, the control unit 6 applies the revised time period as the delay time, whereby the control unit 6 re-sets the automatic timing (step S11).

Working and Effects

As described above, in the article rejecting system 1, an operator performs the manual operation for causing the rejecting unit 5 to perform the rejecting motion at the manual timing, whereby the automatic timing is set based on the manual timing. The operator can perform the input of the manual operation while visually determining the manual timing at which the article G is appropriately rejected, while running the article rejecting system 1. Accordingly, a time required for setting the automatic timing is reduced compared to a case where an operator estimates a delay time and inputs the delay time as a numerical value. Therefore, according to the article rejecting system 1, the automatic timing can be set expediently.

In the article rejecting system 1, the control unit 6 stores the conveyance speed (the first conveyance speed) of the conveyance unit 2 and the time period (the calculated time period or the adjusted time period) from when the detection unit 3 detects the article to when the input unit accepts the input of the manual operation, in association with each other. In this way, performing the manual operation again can be omitted, by using the stored conveyance speed and time period, at the time of restart or the like of the article rejecting system 1, for example.

The article rejecting system 1 is provided with the display unit 8 which displays the time period (the calculated time period) from when the detection unit 3 detects the article G to when the input unit 7 accepts the input of the manual operation, when the input unit 7 accepts the input of the manual operation. The input unit 7 accepts input of an adjustment operation for adjusting the time period displayed on the display unit 8. The control unit 6 sets the automatic timing based on the adjusted time period. In this manner, an operator adjusts the time period displayed on the display unit 8, whereby the automatic timing can be set expediently.

In the article rejecting system 1, when the conveyance speed of the conveyance unit 2 is changed from the first conveyance speed to the second conveyance speed, the control unit 6 re-sets the automatic timing according to the changed second conveyance speed. In this way, even if the conveyance speed of the conveyance unit 2 is changed, the automatic timing according to the changed second conveyance speed is re-set by the control unit 6, and therefore, performing the manual operation again can be omitted. Further, even if the first conveyance speed when an operator performs the manual operation is a conveyance speed lower than the second conveyance speed when the article rejecting system 1 runs normally, since the automatic timing according to the second conveyance speed during the normal running is re-set by the control unit 6, and therefore, the operator can perform the manual operation at the conveyance speed which allows the operator to determine the manual timing easily and visually.

The article rejecting system 1 is further provided with the inspection unit 4. The inspection unit 4 is provided on the upstream side of the rejecting unit 5 in the conveying direction A. The inspection unit 4 inspects the weight of the article G which is conveyed by the conveyance unit 2. In this way, it is possible to reject the article G according to the inspection result (weighing result) of the article G.

In the article rejecting system 1, the input unit 7 is provided to the inspection unit 4. The inspection unit 4 is provided to the transport conveyor 22 provided in alignment with the transport conveyor 23 at which the rejecting unit 5 is provided. In this manner, a place where the input unit 7 is provided is selected according to the distance between the inspection unit 4 and the rejecting unit 5, and therefore, an operator can perform the input of the manual operation while visually observing the rejecting motion of the rejecting unit 5.

Modification

The present disclosure is not limited to the above embodiment.

In the above embodiment, the input unit 7 is provided to the inspection unit 4. However, the input unit 7 may be provided to the rejecting unit 5. In particular, in a case where the inspection unit 4 and the rejecting unit 5 are separated from each other (for example, in a case where the inspection unit 4 and the rejecting unit 5 are separated from each other by several meters to several tens of meters), the input unit 7 may be provided to a portable device distant from the inspection unit 4 and the rejecting unit 5. As the portable device, various devices such as a remote controller or a communication terminal connected to the control unit 6 through wire or wirelessly can be adopted. In this manner, a place where the input unit 7 is provided is selected according to the distance between the inspection unit 4 and the rejecting unit 5, whereby an operator can perform the input of the manual operation while visually observing the rejecting motion of the rejecting unit 5.

In the above embodiment, a case where the inspection unit 4 is provided separately from the detection unit 3 (a photoelectric sensor) is illustrated. However, the inspection unit 4 may function as a detection unit. In this case, the control unit 6 may control the rejecting motion of the rejecting unit 5 based on the inspection result of the inspection unit 4, while controlling the timing of the rejecting motion of the rejecting unit 5 with the detection of the article G by the inspection unit 4 (a change in weighing signal) as a trigger. That is, the control unit 6 may be a circuit configured to execute control of the timing of the rejecting motion of the rejecting unit 5 with the detection of the article G by the inspection unit 4 (a change in weighing signal) as a trigger, and control of the rejecting motion of the rejecting unit 5 based on the detection timing of the article G by the inspection unit 4 and the inspection result of the inspection unit 4. The detection timing in this case is a timing at which the inspection unit 4 detects the article G. In this way, it is possible to omit a part such as a photoelectric sensor, by using the output of the inspection unit 4 as a detection unit.

The article rejecting system 1 may not necessarily have the inspection unit 4. In this case, the control unit 6 may control the timing of the rejecting motion of the rejecting unit 5 with the detection of the article G by a detection unit provided at an upstream end of the transport conveyor 23 as a trigger.

In the above embodiment, an operator performs the input of the manual operation in the setting mode of the conveyance speed lower than the conveyance speed when the article rejecting system 1 runs normally. However, an operator may perform the input of the manual operation in the setting mode of the conveyance speed that is equal to the conveyance speed when the article rejecting system 1 runs normally. In this case, when an operator performs input for causing the article rejecting system 1 to run normally, the control unit 6 may maintain the conveyance speed of the conveyance unit 2 and set the automatic timing by applying, as a delay time, a time period calculated by the control unit 6 when the input unit 7 accepts the input of the manual operation or a time period adjusted by the control unit 6 when the input unit 7 accepts the input of the adjustment operation.

In the above embodiment, the control unit 6 calculates a time period from when the detection unit 3 detects the article G to when the input unit 7 accepts the input of the manual operation and applies the calculated time period as a delay time, whereby the control unit 6 sets the automatic timing. However, a method by which the control unit 6 sets the automatic timing is not limited thereto. For example, the control unit 6 may set the automatic timing by measuring the number of pulses of an encoder in a rotation driving part of the conveyance unit 2 and applying a time period corresponding to the measured number of pulses as a delay time. In this case, the time period corresponding to the measured number of pulses can be calculated by multiplying a time period per pulse corresponding to a rotational speed in the rotation driving part of the conveyance unit 2 by the measured number of pulses. Further, a method by which the control unit 6 sets the automatic timing is not limited to the method based on the delay time. For example, the control unit 6 may measure the number of pulses of the encoder in the rotation driving part of the conveyance unit 2 and use the measured number of pulses. In this case, the control unit 6 may set the automatic timing by measuring the number of pulses of the encoder from when the detection unit 3 detects the article G to when the input unit 7 accepts the input of the manual operation and applying the measured number of pulses as a delay pulse number from when the detection unit 3 detects the article to when the rejecting unit 5 performs the rejecting motion.

In the above embodiment, an inspection device for measuring the weight of the article G which is conveyed by the transport conveyor 22 is illustrated as the inspection unit 4. However, the inspection unit 4 may be, for example, an X-ray inspection device, a seal checker, a near-infrared inspection device, a metal inspection device, or the like.

As the rejecting unit 5, it is not limited to an air jet type rejecting device, and various rejecting devices such as an armnn type rejecting device, a drop belt type rejecting device, a pusher type rejecting device, and the like can be applied. Further, the inspection unit 4 is not limited to a weight inspection device that performs weight inspection, and various inspection devices such as an X-ray inspection device that performs X-ray inspection (for example, foreign matter inspection using X-ray transparency), an optical inspection device that performs optical inspection (for example, biting inspection using light permeability), a metal inspection device that performs metal inspection (for example, metal foreign matter inspection using the interaction between a magnetic field and metal), and the like can be applied. In either case, it is possible to appropriately and easily set the timing of the rejecting motion when the conveyance speed of the conveyance unit 2 is changed.

In the above embodiment, as an example, the type of the article G subjected to a performance of the rejecting motion by the rejecting unit 5 is single. Incidentally, in a case where a plurality of types of articles G are handled as the articles G subjected to the performance of the rejecting motion by the rejecting unit 5, there is a possibility that an appropriate automatic timing may differ for each type of the article G. In this case, the manual timing, by the input of the manual operation of an operator, differs for each type of the article G. That is, the time period from when the detection unit 3 detects the article G to when the input unit 7 accepts the input of the manual operation differs for each type of the article G. In such a case, the control unit 6 and the input unit 7 can be modified as follows.

The input unit 7 accepts input of an article setting operation for setting the article G subjected to the performance of the rejecting motion by the rejecting unit 5. The article setting operation may include a first article setting operation for setting the article G during setting the automatic timing based on the manual timing by the input of the manual operation of an operator, and a second article setting operation for setting the article G (the article G subjected to the weight inspection) when the article rejecting system 1 runs normally. The article setting operation may be, for example, an operation in which an operator selects an image, a character, or the like (for example, an item number or the like stored in advance corresponding to each article G) relating to each of a plurality of articles G displayed on the display unit 8.

The control unit 6 stores the conveyance speed (a first conveyance speed) of the conveyance unit 2 and the time period from when the detection unit 3 detects the article G to when the input unit 7 accepts the input of the manual operation, in association with the set article G, when the input unit 7 accepts the input of the manual operation and the input of the first article setting operation (an article setting operation). The input of the manual operation may be performed before the input of the first article setting operation or may be performed after the input of the first article setting operation. The input of the manual operation may be accepted by the input unit 7, for example, in a state where an operator performed the input of the first article setting operation in advance. The input of the first article setting operation may be accepted by the input unit 7, for example, in a state where an operator performed the input of the manual operation in advance.

If the time period associated with the article G set in the second article setting operation (an article setting operation) is stored when the input unit 7 accepts the input of the second article setting operation, the control unit 6 sets the automatic timing based on the stored time period. More specifically, in a case where the conveyance speed of the conveyance unit 2 and the time period are stored in association with the article G set by the input of the first article setting operation, the control unit 6 sets the automatic timing based on the stored time period, if the article G set by the input of the second article setting operation accepted by the input unit 7 is the same as the article G set by the input of the first article setting operation.

Hereinafter, the setting procedure of the automatic timing in a case of handling a plurality of types of articles G as the article G subjected to the performance of the rejecting motion by the rejecting unit 5 will be described with reference to FIGS. 4 and 5.

Figure 4:
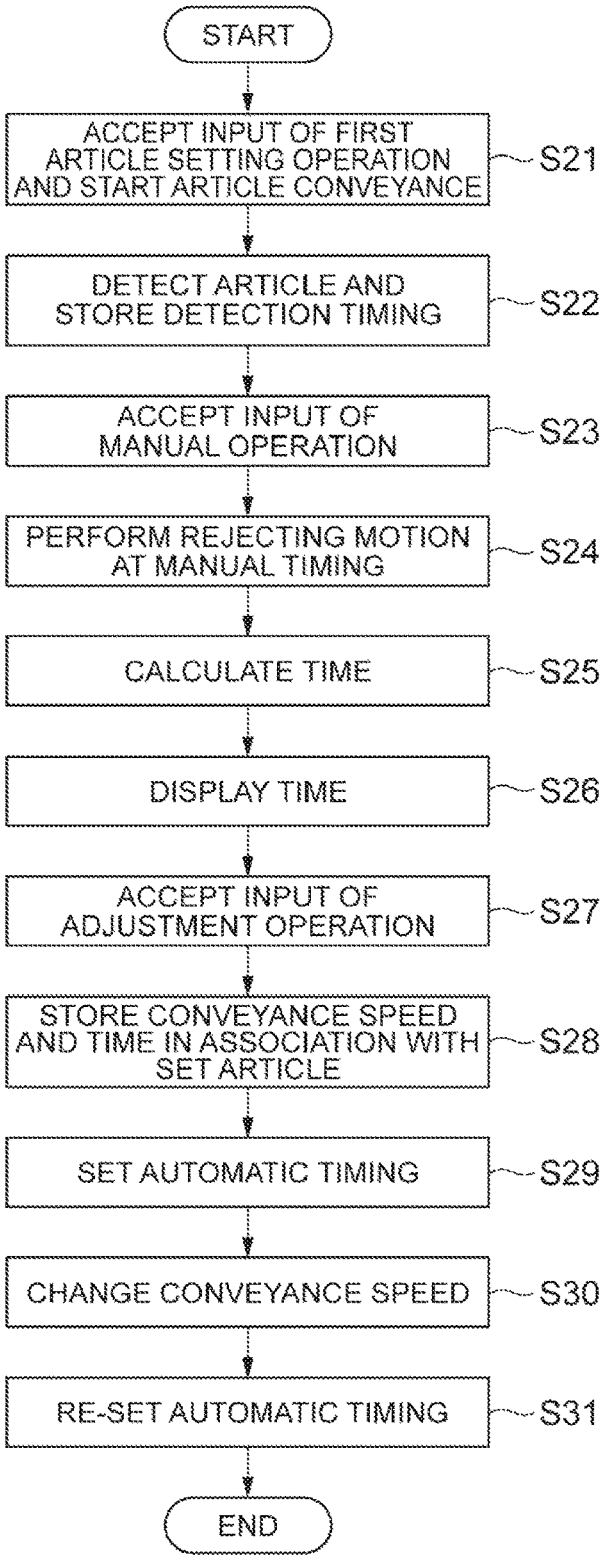
FIG. 4 is another example of a flowchart showing the procedure of setting an automatic timing in the article rejecting system shown in FIG. 1.

First, as shown in FIG. 4, an operator performs input for operating the article rejecting system 1 in the setting mode and input of the first article setting operation for setting the article G subjected to the setting of the automatic timing, among the plurality of types of articles. The control unit 6 causes the conveyance unit 2 to start the conveyance of the article G (step S21). Subsequently, the processing of steps S22 to S27 is performed with respect to the article G. The processing of steps S22 to S27 is the same as the processing of steps S2 to S7 in the above embodiment.

Subsequently, when the input unit 7 accepts the input of the manual operation and the input of the first article setting operation, the control unit 6 stores the conveyance speed of the conveyance unit 2 and the time period from when the detection unit 3 detects the article G to when the input unit 7 accepts the input of the manual operation, in association with the article G set by the input of the first article setting operation. Specifically, in a case where an operator recognizes that the adjustment of the time period calculated in step S25 is required, if the operator performs the input of the timing setting operation when the operator performs and completes the input of the adjustment operation, the control unit 6 stores the adjusted time period and the conveyance speed of the conveyance unit 2 in association with the article G set by the input of the first article setting operation (step S28). Subsequently, the control unit 6 sets the automatic timing by applying the adjusted time period as the delay time (step S29). Alternatively, in a case where the operator recognizes that the adjustment of the time period calculated in step S25 is not required, if the operator performs the input of the timing setting operation without performing the input of the adjustment operation, in step S28, the control unit 6 stores the time period calculated in step S25 and the conveyance speed of the conveyance unit 2 in association with the article G set by the input of the first article setting operation. Subsequently, in step S29, the control unit 6 sets the automatic timing by applying the time period calculated in step S25 as the delay time.

Subsequently, the processes of step S30 and step S31 is performed. The processing in step S30 and step S31 is the same as the processing of step S10 and step S11 in the above embodiment.

Figure 5:
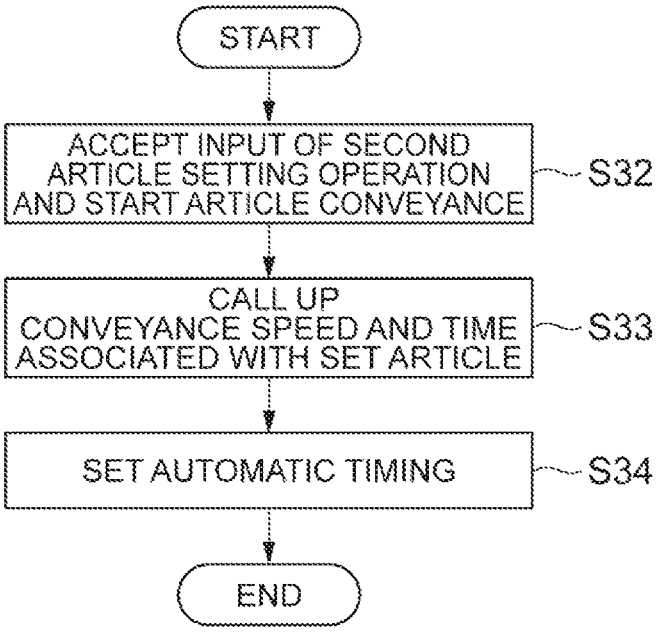
FIG. 5 is an example of a flowchart showing the procedure of calling up a conveyance speed and a time period stored in FIG. 4.

Subsequently, as shown in FIG. 5, in the weight inspection of the article G by the article rejecting system 1 (for example, the inspection of the article G after the restart or the like of the article rejecting system 1), an operator performs input for causing the article rejecting system 1 to run normally, and input of the second article setting operation for setting the article G which is a target to be subjected to the weight inspection, among the plurality of types of articles G. The control unit 6 causes the conveyance unit 2 to start conveyance of the articles G (step S32). When the input unit 7 accepts the input of the second article setting operation, the control unit 6 calls up the conveyance speed of the conveyance unit 2 and the time period associated with the article G set in the second article setting operation (step S33). Subsequently, the control unit 6 sets the automatic timing by applying the called-up time period as the delay time (step S34).

According to the above configuration, for example, in a case of handling a plurality of types of articles G as the articles G subjected to the performance of the rejecting motion by the rejecting unit 5, the conveyance speed and the time period for each article G can be stored in advance in the control unit 6 in association with the article G. In this way, for example, even in a case where an appropriate automatic timing differs for each type of the article G, by using the conveyance speed and the time period stored in advance, the automatic timing can be set according to the article set by the article setting operation without performing the manual operation again.

At least a part of the embodiment and at least a part of the modification example described above may be optionally combined.

What is claimed is:

1. An article rejecting system comprising:

a conveyance unit that conveys an article along a conveying direction;

a detection unit that detects the article which is conveyed by the conveyance unit;

a rejecting unit that is provided on a downstream side of the detection unit in the conveying direction and performs a rejecting motion for rejecting the article which is conveyed by the conveyance unit;

a control unit that controls the rejecting unit such that the rejecting motion is performed at a predetermined automatic timing when the detection unit detects the article; and an input unit that accepts input of a manual operation for causing the rejecting unit to perform the rejecting motion at a manual timing while the article rejecting system is operating, the control unit being configured to calculate and set the automatic timing based on the manual timing, with the input unit accepting the input of the manual operation while the detection unit detects the article.

2. The article rejecting system according to claim 1, wherein the control unit stores a conveyance speed of the conveyance unit and a time period from when the detection unit detects the article to when the input unit accepts the input of the manual operation.

3. The article rejecting system according to claim 1, further comprising:

a display unit that displays a time period from when the detection unit detects the article to when the input unit accepts the input of the manual operation, when the input unit accepts the input of the manual operation, wherein the input unit accepts input of an adjustment operation for adjusting the time period displayed on the display unit, and the control unit sets the automatic timing based on the adjusted time period.

4. The article rejecting system according to claim 1, wherein the control unit re-sets the automatic timing according to a conveyance speed when the conveyance speed of the conveyance unit is changed.

5. The article rejecting system according to claim 1, further comprising:

an inspection unit that is provided on an upstream side of the rejecting unit in the conveying direction and inspects the article which is conveyed by the conveyance unit.

6. The article rejecting system according to claim 5, wherein the input unit is provided to at least one of the inspection unit, the rejecting unit, and a portable device distant from the inspection unit and the rejecting unit.

7. The article rejecting system according to claim 1, wherein the detection unit is an inspection unit that inspects the article which is conveyed by the conveyance unit, and the control unit controls the rejecting unit such that the rejecting motion is performed at the automatic timing when the inspection unit inspects the article.

8. The article rejecting system according to claim 1, wherein the input unit accepts input of an article setting operation for setting the article subjected to a performance of the rejecting motion by the rejecting unit, and the control unit stores a conveyance speed of the conveyance unit and a time period from when the detection unit detects the article to when the input unit accepts the input of the manual operation, in association with the set article, when the input unit accepts the input of the manual operation and the input of the article setting operation, and sets the automatic timing based on the stored time period associated with the article set by the article setting operation, if the time period is stored when the input unit accepts the input of the article setting operation.

* * * * *